United States Patent [19]

O'Hara

[11] 4,345,950

[45] Aug. 24, 1982

[54] METHOD FOR MAKING A COMPOSITE GRAINED CAST ARTICLE

[75] Inventor: Kevin S. O'Hara, Peabody, Mass.

[73] Assignee: General Electric Company, Cincinnati, Ohio

[21] Appl. No.: 142,527

[22] Filed: Apr. 21, 1980

[51] Int. Cl.[3] ..... C22F 1/10

[52] U.S. Cl. ..... 148/2; 148/11.5 N; 148/32; 148/39

[58] Field of Search ..... 148/11.5 N, 32, 32.5, 148/2, 3, 39; 75/170, 171; 164/72

[56] References Cited

U.S. PATENT DOCUMENTS

| | | | |
|---|---|---|---|
| 3,008,855 | 11/1961 | Swenson | 75/171 |
| 3,413,204 | 11/1968 | Rexer et al. | 204/140.5 |
| 3,494,709 | 2/1970 | Piearcey | 75/171 |
| 3,572,419 | 3/1971 | Barrow etal. | 164/60 |
| 3,967,355 | 7/1976 | Giamei et al. | 29/194 |
| 4,184,900 | 1/1980 | Erickson et al. | 75/171 |

*Primary Examiner*—R. Dean

*Attorney, Agent, or Firm*—Lee H. Sachs; Derek P. Lawrence

[57] ABSTRACT

A composite grained cast article is provided from a superalloy casting in the single grained condition, in one form, by mechanically working a portion of the article intended to operate at a lower temperature of up to about 1300° F. The mechanically worked portion is then recrystallized by heating to provide a multi-grained portion. In another form, the multi-grained portion is provided by selective use of grain nucleation material during solidification.

3 Claims, No Drawings

METHOD FOR MAKING A COMPOSITE GRAINED CAST ARTICLE

BACKGROUND OF THE INVENTION

1. Field of the Invention

This invention relates to metal casting and, more particularly, to a composite grained cast article made from a single grained article.

2. Description of the Prior Art

Improvements in gas turbine engine technology have been based, in part, on a utilization of improved high temperature alloys and the condition of the grain structure of such alloys in article form. One of the more widely used types of alloys employed in hot sections of gas turbine engines are those based on the element nickel, or cobalt, or both. Such articles as turbine blades and vanes are conveniently manufactured by the well-known lost-wax type precision casting process. However, the turbine engine designer currently has available to him several microstructures or crystal forms from which to select. Such selection is based on properties desired by the designer and the relative cost of manufacturing such a form of the article. For example, multi-grained castings have been provided with nucleation controlled in a manner as is described in U.S. Pat. No. 3,158,912—Schweikert. Subsequently, methods and apparatus were developed to provide such articles with an elongated grain structure as a result of directional solidification during the casting process. Such a grain structure provides improved high temperature properties predominantly in respect to thermal fatigue life over conventionally cast structures having equiaxed grain structure of the type provided through practice of the invention described by the Schweikert patent. One such method and apparatus for conducting directional solidification is described in U.S. Pat. No. 3,897,815—Smashey. Further adjustment of casting properties has been recorded in such patents as U.S. Pat. No. 3,494,709—Piearcey in connection with the generation of a single grained cast part and U.S. Pat. No. 4,033,792—Giamei et al. in connection with composite articles fabricated from a plurality of members at least some of which are of the single grained type. The disclosures of these patents are incorporated herein by reference.

Provision of a unitary cast article having a composite grained structure can provide desirable mechanical properties in different parts of the article experiencing different conditions, for example, the airfoil portion and the attachment portion of a high temperature operating turbine blade or vane.

SUMMARY OF THE INVENTION

An object of the present invention is to provide an improved method for making a composite grained cast article from a unitary casting of a high temperature superalloy whereby the casting has a single grained condition in one portion and a multi-grained condition in another portion of the unitary cast structure without involving fabrication of a plurality of components.

This and other objects and advantages will be more clearly understood from the following detailed description and the examples all of which are intended to be representative of rather than in any way limiting on the scope of the present invention.

One form of the method of the present invention for making a composite grained cast article from a unitary casting includes providing a unitary cast article of a high temperature superalloy or the type based on Ni or Co or both, in the single grained condition. The alloy has good creep rupture and thermal fatigue high temperature properties in the single grained condition and is capable of developing good high cycle fatigue properties in a lower operating temperature range of up to about 1300° F. in a multi-grained condition. A portion of the single grained, unitary cast article, intended to operate in the lower temperature range, is subjected to mechanical work, such as by impacting, to provide permanent plastic deformation sufficient to enable recrystallization of that portion when the portion is heated at an elevated, recrystallization temperature. For example, for nickel base superalloys, such heating is at a temperature of from at least the gamma prime solution temperature range of the alloy up to, but not including, that temperature which affects detrimentally the alloy of the article. When the unitary cast article is of a cobalt base alloy, the temperature of heating to recrystallize is from at least about 1600° F. up to, but not including, that temperature which affects detrimentally the alloy of the article. After working, the worked portion of the article is heated at such recrystallization temperature for a time sufficient to recrystallize the worked portion of the article. Thus, the recrystallized portion is provided with high cycle fatigue resistance greater than that of the remaining single grained portion.

In the article formed from the present invention, there is provided a composite grained unitary article cast from a selected high temperature superalloy, the article including a single grained portion intended to operate at elevated temperatures and characterized by good creep rupture and thermal fatigue properties and a multi-grained portion intended to operate at a lower temperature of up to about 1300° F. characterized by improved high cycle fatigue properties as compared with the single grained portion.

DESCRIPTION OF THE PREFERRED EMBODIMENT

In an evaluation of the present invention, the effect of the imparting of mechanical work to a casting was considered. Such mechanical work provides permanent plastic deformation at a temperature below the recrystallization temperature to enable recrystallization to occur when the worked casting portion is heated at a temperature and for a time which will enable the formation of new grains. One type of nickel base superalloy considered in connection with the present invention is sometimes referred to as SEL alloy and has the nominal composition, by weight, of 0.08% C, 15% Cr, 22% Co, 4.4% Mo, 2.4% Ti, 4.4% Al, 0.015% B with the balance Ni and incidental impurities.

The following Table I lists processing conditions associated with such alloy. In Table I, the age heat treatment for the SEL alloy was 1435° F. for 16–32 hours and the recrystallization and age processing was 1925° F. for 4 hours than 1435° F. for 16–32 hours. Commercially available Almen strips were used to determine the "A" and "N" intensities for permanent plastic deformation.

TABLE I

| PROCESSING CONDITIONS | |
|---|---|
| CONDITION | PROCESSING |
| 1 | As-cast + age + steel shot peen to 5-6A intensity |
| 2 | Condition 1 + recrystallize + age |
| 3 | Condition 2 + additional glass shot peen to 8-10N intensity |
| 4 | Condition 2 + additional glass shot peen to 6-8A intensity |

TABLE II

| ENDURANCE FATIGUE DATA SUMMARY Cast SEL Alloy Articles | |
|---|---|
| CONDITION | STRENGTH (ksi) |
| 1 | 23 |
| 2 | 43 |
| 3 | 48-55 |
| 4 | 34 |

The castings processed according to Table I were in the multi-grained condition. Nevertheless, the improvement in endurance fatigue strength from practice of the present invention can be seen from the data of the above Table II, particularly for condition 3. In Table II, "ksi" means "thousands of pounds per square inch".

The method of the present invention can be used in connection with a variety of metal castings. For example, in the gas turbine art, it can be used to generate a variety of blading members including a single grained airfoil and multi-grained portions such as bases or dovetails, platforms, airfoil interlocks, airfoil platforms, vane attachment means, etc. Thus the selective mechanical working of a portion of a cast single grained article provides a designer with flexibility to select those mechanical properties most advantageous for an application.

Another method by which the article associated with the present invention can be made includes the selective nucleation of grains as a single grained article is being cast. According to such method, there is provided a directional solidification precision casting type mold ordinarily used in manufacture of single grained articles. A variety of such molds have been described in the art, including the above-incorporated patents. Such a mold is modified by including at one or more selected wall portions a grain nucleating material, for example, compounds such as oxides as described in the above-incorporated Schweikert patent. Thereafter, the single grain casting method is conducted by first introducing into the mold a molten superalloy and then solidifying the molten superalloy by passing a solidification front through the mold. Thus, there is generated in an article forming portion of the mold first a single grained portion and then a multi-grained portion at the selected wall at which the nucleating material was included.

Although the present invention has been described in connection with specific examples, it will be understood by those skilled in the art the variations and modifications of which the present invention is capable.

What is claimed is:

1. A method for making a composite grained unitary cast article from a unitary casting of a high temperature superalloy based on at least one element selected from the group consisting of Ni and Co, comprising the steps of:

providing the unitary cast article in the single grained condition from an alloy which has good creep rupture and thermal fatigue high temperature properties in the single grained condition and is capable of developing good high cycle fatigue resistance properties in a lower temperature range of up to about 1300° F. in a multi-grained condition;

subjecting a first portion of the single grained article intended to operate in the lower temperature range to mechanical work to provide permanent plastic deformation in the surface of the first portion sufficient to enable recrystallization of the first portion when the first portion is heated at a recrystallization temperature, said recrystallization temperature being from at least the gamma prime solution temperature range of the alloy up to but not including that temperature which affects detrimentally the alloy of the article when the superalloy is based on Ni, and being from at least about 1600° F. up to but not including that temperature which affects detrimentally the alloy of the article when the superalloy is based on Co; and then heating at least the first portion of the article at the recrystallization temperature for a time sufficient to recrystallize the first portion of the article to a multi-grained condition thus to provide the recrystallized first portion with high cycle fatigue resistance greater than that of the remaining single grained portion.

2. The method of claim 1 in which the mechanical work is imparted to the article by impacting the surface of the article.

3. The method of claim 1 in which the remaining single grained portion is an airfoil of a blading member.

* * * * *